US010934119B2

(12) United States Patent
Troxler et al.

(10) Patent No.: US 10,934,119 B2
(45) Date of Patent: Mar. 2, 2021

(54) PRINTING SHEET BRAKE

(71) Applicant: Mueller Martini Holding AG, Hergiswil (CH)

(72) Inventors: Christian Troxler, Rain (CH); Roger Luescher, Lucerne (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 16/281,118

(22) Filed: Feb. 21, 2019

(65) Prior Publication Data

US 2019/0263618 A1 Aug. 29, 2019

(30) Foreign Application Priority Data

Feb. 28, 2018 (CH) ..... 00240/18

(51) Int. Cl.

| | |
|---|---|
| ***B65H 29/68*** | (2006.01) |
| ***B65H 9/14*** | (2006.01) |
| ***B65H 45/18*** | (2006.01) |
| *B41F 21/00* | (2006.01) |

(52) U.S. Cl.

CPC ..... *B65H 29/686* (2013.01); *B65H 9/14* (2013.01); *B65H 29/68* (2013.01); *B65H 45/18* (2013.01); *B41F 21/00* (2013.01); *B65H 2301/44921* (2013.01); *B65H 2404/64* (2013.01); *B65H 2406/122* (2013.01); *B65H 2701/1313* (2013.01)

(58) Field of Classification Search

CPC ..... B65H 29/686; B65H 29/68; B65H 29/24; B65H 9/14; B65H 29/6618; B65H 2406/122; B65H 2301/4492; B65H 45/18; B65H 2701/1313; B65H 2301/44921

See application file for complete search history.

(56) References Cited

U.S. PATENT DOCUMENTS 4,053,150 A * 10/1977 Lane ..... B65H 45/18 493/417
4,549,728 A * 10/1985 Odeau ..... B65H 29/68 270/46
5,718,176 A 2/1998 Stephan (Continued)

FOREIGN PATENT DOCUMENTS

DE 4307383 A1 * 9/1994 ..... B65H 29/68
DE 19921169 A1 11/2000

(Continued)

*Primary Examiner* — Luis A Gonzalez
(74) *Attorney, Agent, or Firm* — Leydig, Voit & Mayer, Ltd.

(57) ABSTRACT

A device for decelerating a transported and flat shaped product includes a brake operable by an air jet supplied by an air jet nozzle. The air jet nozzle is configured to impinge the air jet on a braking force implementing body to exert a braking force on the flat shaped product. The braking force implementing body includes: at least one first element, which has a physical structure for a return-flow of the air jet supplied by the air jet nozzle, and at least one second element, which for the braking force implementation is in an operative connection with the first element. The second element is configured to implement an impulse force caused by the air jet from the air jet nozzle. The impulse force results as the braking force onto the flat shaped product.

34 Claims, 3 Drawing Sheets

(56) References Cited

U.S. PATENT DOCUMENTS

| | | | | |
|---|---|---|---|---|
| 6,000,695 | A * | 12/1999 | Mack | B41F 21/08 271/183 |
| 6,398,211 | B1 | 6/2002 | Schalk | |
| 2007/0096382 | A1* | 5/2007 | Komori | B65H 29/6618 271/9.09 |
| 2016/0096358 | A1 | 4/2016 | Duss et al. | |
| 2016/0096359 | A1 | 4/2016 | Duss et al. | |
| 2019/0263622 | A1* | 8/2019 | Troxler | B31F 5/005 |

FOREIGN PATENT DOCUMENTS

| | | | |
|---|---|---|---|
| EP | 0755887 | A2 | 1/1997 |
| EP | 3002240 | A1 | 4/2016 |
| EP | 3002241 | A1 | 4/2016 |

* cited by examiner

PRINTING SHEET BRAKE

CROSS-REFERENCE TO PRIOR APPLICATIONS

Priority is claimed to Swiss Patent Application No. CH 00240/18, filed on Feb. 28, 2018, the entire disclosure of which is hereby incorporated by reference herein.

FIELD

The present invention relates to a printing sheet brake.

BACKGROUND

The direction changes of the printing sheet parts, injected through various folding processes, generally cause high deceleration and acceleration values to the printing sheet parts to be folded. The deceleration and acceleration forces, resulting from the deceleration and acceleration values as well as the mass of the deflected printing sheet parts, have a negative effect on product quality as well as on the stability of the folding process. In addition, there is market demand for higher production capacities in order to accordingly reduce costs per unit time or product.

EP3002240 A1 and EP3002241 A1 disclose brake devices, which are sometimes operated with a pneumatic medium (air). Such brake devices have the advantage that they can come up with very fast reaction times, compared with known mechanical or electromagnetic systems, in particular also due to the very low mass inertia of the braking system. Furthermore, such brake devices operated with a pneumatic medium, apart from the complementary brake pads, are largely free from maintenance and wear.

Accordingly, EP3002240 A1 discloses a device and a method for decelerating and positioning a printing sheet in a process machine. Along the feeding direction of the printing sheet, there is at least one means which exerts a braking force effect on the printing sheet, and thus the positioning of the printing sheet in connection with the operational process of a downstream process station is achieved.

The focus of this prior art is to be seen in that the whole deceleration process is characterized by the deceleration and positioning of a printing sheet. Therefore, the final orientation of the printing sheet is accomplished by a twofold braking action, its braking arrangements can be operated together according to various principles, and the two braking arrangements can also be partially operated with "and/or"-coupling.

Essentially, EP3002240 A1 shows various possibilities of how the deceleration and positioning of a printing sheet can take place:

In the direct implementation, it is in such a way that the air impulses triggering braking forces are aimed directly at the printing sheet and there unfold and/or realize their effect, wherein the number, strength and point of action of these air impulses can be adjusted to the given conditions.

In the indirect implementation, it is in such a way that the air impulses triggering breaking forces act upon at least one mechanical element, which is situated intermediately between a printing sheet and an air impulse nozzle, so that the effective braking action on the printing sheet is then carried out by the mechanical element, and such an element may have various dynamic configurations.

In addition, the positionally accurate deceleration of a printing sheet in the feeding direction can be achieved at least partially also by other decelerations acting on the printing sheet, for example, by installing a braking force, affected by negative pressure, which is usually situated below the transport belts, having an effect on the printing sheets. By such a measure, the friction between the surface of the table-like pads and the underside of the printing sheet increases in such a way that such a frictional force can preferably be used as a fine adjustment for an accurate final positioning of the printing sheet. As already mentioned above within the context of the air impulses, the number, strength and point of action can also be adjusted to the given conditions for the implementation of the negative pressure on the printing sheet.

The two effective braking forces, thus the braking force-triggering impulses on the printing sheet, whether they are operated directly or indirectly, as well as an increase in friction by another braking force, can be controlled interdependently or independently, and the braking force portion of the two effective breaking forces can be changed and/or adjusted case by case.

Of course, an additional braking force can also be accomplished by at least one mechanically activatable element, which can be used for a fine adjustment, for example, in addition to pneumatic braking force-triggering impulses acting on the printing sheet, and such a mechanical element can be readily operated by an autonomous control or, in the above sense, purely by air impulses.

Furthermore, EP3002241 A1 discloses a brake device which is designed as a transverse removal printing sheet break. In this case, here it is also a method for decelerating and positioning the printing sheet in the feeding direction as well as for delaying the printing sheet during the folded infeed and/or against the occurring flapping movements in a retracted printing sheet, and this is achieved by the following process steps:

i) On the basis of the given production data such as folding scheme, paper weight, paper width, cut length, the air pressure required for braking is calculated, and the information is sent to the automatic pressure regulator, taking into account that depending on the folding scheme, the printing sheets may have different values on the left side and right side;

ii) A pressure accumulator having a pressure regulator ensures the physical values of the required compressed air;

iii) The printing sheet entering into/supplied to the folding area is detected at the trailing edge by means of a light barrier, this light barrier simultaneously serving the timing-accurate synchronization of the folding blade, the light barrier compensating for irregularities within the transport of the printing sheet;

iv) On the basis of the released triggering signal, a signal for the activation of the pneumatic switching valve is triggered, taking into account dead time and speed compensation;

v) Then, the air stored in the pressure accumulator is suddenly released, whereupon the air nozzle releases an impulse-like air blast;

vi) The released air blast now acts directly onto the printing sheet or indirectly onto a lever, which transmits the air blast and the corresponding normal force onto the printing sheet;

vii) In this instance, the printing sheet during the feeding process and/or during the folding process is pressed onto a table-like pad, and by friction generates a braking force onto the sheet;

viii) Optionally, an additional braking force is simultaneously exerted or when the pressure is out-of-phase onto the trailing edge of the printing sheet, the printing sheet being stiffened by stretching the material, which is triggered by the braking action;

ix) The braking time point is selected so that the printing sheet is safely decelerated to 0, for example if it is applied directly to the printing sheet stop or that the folding blade takes over the printing sheet or during the folding process delays it to that extent;

x) After releasing the air impulses, the pneumatic switching valve is immediately closed and is then available for the next cycle.

In summary, it can be said that the brake devices belonging to the prior art, are preferably designed for interdependent brake systems, their braking effect being provided by various auxiliary equipment, designed having different brake techniques and variously controlled braking and/or impulse forces.

SUMMARY

An embodiment of the present invention provides a device for decelerating a transported and flat shaped product that includes a brake operable by an air jet supplied by an air jet nozzle. The air jet nozzle is configured to impinge the air jet on a braking force implementing body to exert a braking force on the flat shaped product. The braking force implementing body includes: at least one first element, which has a physical structure for a return-flow of the air jet supplied by the air jet nozzle, and at least one second element, which for the braking force implementation is in an operative connection with the first element. The second element is configured to implement an impulse force caused by the air jet from the air jet nozzle. The impulse force results as the braking force onto the flat shaped product.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
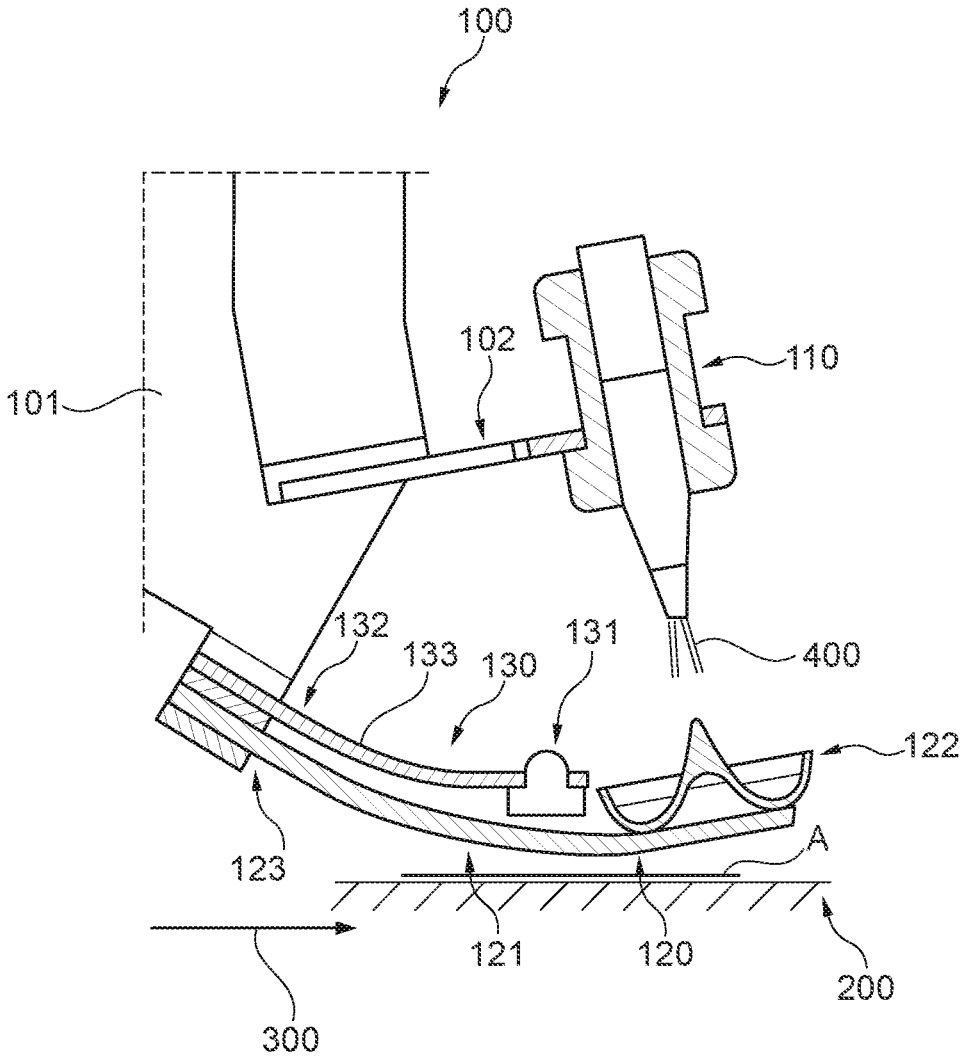
FIG. 1 shows an overall view of a printing sheet brake, which is equipped with a shell.

The present invention provides a highly efficient brake, preferably for products of a general kind, preferably for printing products, in particular for printing sheets, which is operated by a braking force provided by impulses, which is provided by a pressurized pneumatic medium, and which is capable of exerting an efficient braking force onto a body by transmitting an impulse force, which body then exerts the braking force directly onto the product, whereupon an immediate braking effect is generated.

In an embodiment, the body does not strike the product directly, but indirectly by inserting complementary auxiliary equipment. In both cases, it is such that this braking force, both in direct and indirect implementation, can detect the products fed individually at high running speeds and at high cycle numbers.

While discussion of embodiments of the present invention is in relation to individual products, the invention is not so limited; equally the brake according to the present invention can be used, for example, in the processing of a single or multiple folded printing products. It is even possible that this brake can be used for printing products in a scaled configuration.

In the following, as intended, only printing sheets, possibly printing products, are discussed, without implying exclusivity.

The brake according to the present invention is therefore preferably used for printing products, however without excluding that the brake according to the present invention can also be readily used for other flat designed transportable products of various thicknesses and material compositions.

For practical considerations, therefore, the brake according to the present invention in the following is focused on the braking effect onto printing sheets.

For this purpose, this brake according to the present invention consequently is then subsequently exclusively called printing sheet brake and described as such, designed in such a way that within a time period in the range of milliseconds (ms), the individual printing sheets transported and fed at a high speed are abruptly decelerated to zero and, at the same time, are position-accurately positioned for subsequent processing.

The position-accurate positioning of the decelerated printing sheet is crucial for quality assurance, in particular based on the following operations. This quality assurance can be maximized by supplementing the system with a printing sheet stop, which comes into action at the very last phase of deceleration and which ensures that any possible misalignment caused by transportation or possibly by the implementation of the braking force can be definitely offset by 100%.

In so doing, the released kinematic energy is only minimally present during the local impingement of the printing sheets on the printing sheet stop, because by the deceleration according to the present invention, this feeding-related kinematic energy has been almost completely depleted.

Therefore, only a feeding speed approaching zero is then left, which ensures that the printing sheet can be smoothly aligned to the stop surface of the printing sheet stop. The printing sheet stop may be a single body, which covers substantially the entire feeding width of the printing sheet or is made up of a number of spaced-apart body parts. It is obvious that there is an interdependence between the remanence speed of the printing sheet and the braking force during its implementation not being fully exhausted.

The final positioning of the printing sheet is therefore determined with the assistance of a printing sheet stop, but nevertheless, it must be ensured in all cases that the printing sheet by its remanence speed strikes the stop surface of this printing sheet stop only very gently. Because this remanence speed is small, as illustrated, there is no danger that the front edge of the printing sheet in the feeding direction, when striking the stop surface, could be damaged and/or spring back from this stop surface.

This gently executed process regarding the final position of the printing sheet also has the advantage that the printing sheet can be completely aligned with the course of the stop surface(s), resulting in a definitively maximized accurate alignment of the printing sheet, this accurate alignment of the printing sheet then being critical for quality assurance in subsequent operations.

In this context, the following specifications are important: the switching of the pneumatic valve is usually carried out within a time period of 8-10 ms. About 50% of this time period, i.e., 4-5 ms, are consumed for the shutting-down of the first flexible braking-force implementing element, and the remaining, approximately 50% of this time period, i.e., 4-5 ms, come into effect for the actual braking process. This means that the deceleration of the entry speed of the printing sheet to zero is thus within a time period of at most 5 ms.

In itself, the application time can be changed as a function of the positioning and the distance of the actual brake body relative to the printing sheet. The originally stated values apply to a maximum distance of approx. 10 mm between the brake body and the printing sheet, which normally corresponds to an operating mode having different infeed and folding height of the printing sheets, and the brake and the feeding cadence of the printing sheet can be so designed that also a "scaled" folding can be used, i.e., the printing sheet to be folded is still on the folding table, while the following printing sheet is supplied in an overlying manner.

In an arrangement regarding a specified folding machine, in which the inlet height corresponds to the folding level, it must be ensured at the beginning of the operation that a previous printing sheet then no longer remains in place. In this case, the distance between the brake and the printing product varies between 0 and approx. 3 mm. In this case, this means that the proportion of the lowering movement of the brake, thus of the brake body, is approx. 30% and the actual braking time is approx. 70% of the total braking time available.

In both cases, it must be ensured that the braking time is not significantly less than 5 ms, so that, whenever possible, it should be aimed for that the lowering movement is not longer than 3 ms.

Therefore, by a single modeled braking force, a gentle, secured and accurate local positioning of the individual sheets can be achieved, which is of crucial importance for the subsequent processing of these printing sheets.

For this purpose, according to the present invention, a body is provided as an implementation means of the force-determining impulse generated by an air jet nozzle, which basically has further complementary elements, which allow an efficiency-maximized air jet deflection.

The speed of the air flow from the air jet nozzle is almost supersonic, when assuming a turbulent flow, thus is of the magnitude of approx. 316 m/s. In a laminar flow, this speed can be increased to approx. 500 m/s. This is the case, for example, if the flow structure of the air jet nozzle is designed as a Laval nozzle.

This air jet deflecting body is preferably arranged above the transported printing sheet and is directly in an operative connection with a flexible element clamped on one side, the resilience and/or spring constant of which indicates the transferability of the pressing force onto the printing sheet. The underside of this flexible element therefore exerts a pressing force, generated by the air jet via the air jet deflecting body, onto the printing sheet, which pressing force then comes into effect as a direct braking force, in such a way that the detected printing sheet can be immediately and fully decelerated to zero.

One possibility to reduce the swinging movement of the flexible component of the first element after the generated braking impulse, and/or to aim it at zero can be achieved by various measures:

a) On the one hand, it can be acted onto the material-related spring constant of the flexible component of the first element, be it by selectively choosing materials or by a multi-layered sheet structure of this flexible component, which preferably has the form of a tab.
b) On the other hand, mechanical damping elements can be provided, which counteract the swinging movement of the flexible component of the first member, for example, in that the damping bodies are made of vibration-damping materials. Basically, these should be such that they introduce a minimized additional mass into the system.
c) Furthermore, it is possible that the air jet impact, initiated for the braking, is not abruptly interrupted in the follow-up of the carried-out braking, but is only so far reduced, that a counterforce against the out-swinging movement of the flexible component of the first element results as a consequence.
d) Further, the air jet nozzle can be configured in such a manner that, in addition to the central opening intended for the main action of the brake, a further complementary opening is provided, which alternatively has a dampening effect on the out-swinging movement of the flexible component of the first element. This second opening then comes into function only subsequent to the main air blast out of the main opening by a corresponding air blast, and for the damping is to be modeled corresponding to the force.
e) Finally, the centrally placed main opening of the air jet nozzle can be supplemented by a number of smaller holes arranged in a ring shape, from these ring-shape arranged holes preferably an air mass being introduced, which vis-a-vis the out-swinging movement of the flexible component of the first element can introduce a damping.

A combination of these damping arrangements and damping means with each other is also possible.

The impulse-receiving body, preferably in the form of a shell, has a jet-deflecting structure inside of the body, which is formed so that the air jet is first applied to the body centrally or along a plane through center of gravity, and then arranged, and thus can flow without turbulence.

In this instance, the shape of the air jet deflecting structure of this body is preferably formed either in a rotationally concave shape, or the body has a centrally stretched edge on the side of the air jet nozzle, from which the wing-shaped air jet deflecting structure spreads downwards.

In order to guide the impulse-rate evenly via the two wing-shaped air jet deflecting structures, this centrally stretched edge extends along a plane through center of gravity of the body with respect to the two subsequent air jet deflecting wings, which then also turn into a concave shape at the side of the ends, whereby here also an orderly outflow of the introduced air jet mass is ensured, and consequentially is carried out without air-related interference on the respective printing sheets transported thereunder.

Within the two focused jet-deflecting bodies, but which are not to be understood as a final design in terms of the shape, the air jet flows over the air jet deflecting structures of the body up to the concave or quasi-concave curvatures, from which the flow from the air jet nozzle is then finally deflected in the opposite direction to the flow of the original air jet.

In this final deflection, then a maximized vortex-free, upwardly directed return-flow is generated, which flows off by approx. 90° up to ≥180° laterally of the air jet nozzle. Only by this impulse-rate-giving deflection of the air mass flow supplied via the air jet nozzle, the braking forces required for the brake-triggering pressing are implemented first on the body itself and then at the same time also on the flexible element clamped preferably on one side, which is in an operative connection with the body, the printing-sheet sided undersurface of which implements the ultimate pressing onto the printing sheet.

As far as the air mass flow per braking process is concerned, this deflection is a function of the braking force and thus also of the pressure. Sometimes this amount of air jet is then also dependent on the mass of the printing sheet to be decelerated, paper width, folding scheme, the number of paper layers, paper basis weight, section length playing a control role for the printing sheet itself.

Based on the list of the given production data, which are not to be understood conclusive, the air pressure required for braking is calculated, and the information is sent to the automatic pressure regulator. In this instance, depending on the folding scheme, the printing sheets may have different values on the left side and right side. In such a constellation, the brake and/or its braking effect are/is then regulated accordingly.

As far as the switch of the pneumatic valve is concerned, this is, under consideration of dead time and speed compensation, triggered by a signal. Subsequently, the air stored in the pressure accumulator is released abruptly, whereupon the air jet nozzle emits an impulse-like air jet blast.

After the emission of the air impulse, the pneumatic switching valve is immediately closed, and the pressure regulator fills the air reservoir again with the preset pressure and is available for the next cycle.

However, an operation with an air reservoir is not indispensable: The cycle-conditioned impulse emission of a certain amount of air under a certain pressure can also be achieved by a dynamically designed control, which directly ensures a continuous compressed-air supply.

Furthermore, the injection of the air mass flow provided by the air jet nozzle, is preferably carried out completely intermittently, i.e., proceeding from zero to a maximum. pressure and then goes back to zero. However, it is possible, if necessary, to operate the air jet nozzle with a remanence pressure intermediarily after the braking process took place, so that the application time during the next cycle can be further reduced.

As mentioned, the body, according to a preferred variant, is rotationally symmetrically or quasi-rotationally symmetrically configured, is supplemented by a protruding, centrally situated conical or nearly conical column, which projects above the shell of the body, and which is configured taperingly in a streamline shape from the top to the concave outlet of the body, so that it transitions from top to bottom in a flow-conforming manner into the predetermined concave shape in the rotationally symmetric body.

The air mass centrally introduced from the air jet nozzle, is thus distributed in terms of flow evenly in the circumferential direction of the centrally situated conical or nearly conical column, and then this air mass flows, while maintaining a maximized laminar flow, into the concave recess of the body, to then there exert the desired impulse force by the forced deflection. Therefore, those requirements are fulfilled by these flow characteristics leading to an energy transfer which is largely without losses.

Furthermore, it is ensured by this design that, after the work is completed, the air jet can largely flow back toward the direction of the air jet nozzle, through the bottom-side concave curvature of the body, and thus cannot exert any interference conditioned on the air side onto the printing sheet.

Furthermore, the printing sheet brake, on which the present invention is based, includes further advantageous effects going beyond the point-precise immediate braking effect on the printing sheet, in that such a printing sheet break simultaneously ensures that no collision point with the next printing sheet at the printing sheet trailing edge located on the folding table can occur. Important in this configuration is the underlying operational basis, according to which the next printing sheet is guided higher than the surface of the folding table.

The same advantages in the described air jet deflection can thus be achieved even in a body not completely rotationally symmetrical, in which the air jet from the air jet nozzle does not impinge on a centrally situated conical or nearly conical column, but acts upon a deflection element, which has at least one centrally situated separating edge on the air jet side equally dividing the air jet mass, each subset then flowing along the flow-conforming, preferably also tapered, and/or wing-like wall to the flow deflection. This deflection here also releases an impulse force, before the air jet can then flow upwards and/or laterally at a >90° return-flow angle.

In this instance, it is emphasized that such a separating edge does not necessarily have to extend parallel to the feeding direction of the transported printing sheet but, if necessary, can also extend transversely thereto.

In addition, the shell-shaped jet deflecting body can also be configured without a centrally situated flow-conforming column, and the lateral walls of the shell can then readily form a not completely rotationally symmetrical body.

The printing sheet brake according to the present invention can also be used advantageously in an operative connection with a high-performance folding device.

In such a folding process, it must be ensured that at no time, a mechanical collision between the decelerated printing sheet, the folding unit and the next printing sheet can occur.

The printing sheet is thus position-accurately decelerated by way of the printing sheet brake according to the present invention, and then at the same time has an exact position in the feeding direction, if necessary, with the introduction of an acting stop. Accordingly, the operation of the printing sheet brake according to the present invention ensures that the printing sheet trailing edge is located on the folding table and thus no collision with the next printing sheet can occur.

Due to the significantly shortened folding impulse time of the high-performance folding device and by using the printing sheet brake according to the present invention, which in itself does not include any mechanically moving parts and therefore also does not have, or only has, a small mass inertia, the next printing sheet can be fed immediately after the onset of the folding process via a feeding position which is slightly heightened by the conveyor belts.

The printing sheet brake according to the present invention makes it possible to not process the printing sheet in a scaled manner, in particular because the time requirement of the printing sheet brake can be reduced to a minimum, namely <10 ms. That means that the gap between the products is based on a time constant, which then is dependent on the production speed of the printing machine, the resulting number of cycles and the printing sheet-related section length, and these conditions can be operatively fully recovered by the brake according to the present invention.

A reduction of the gaps between the individual printing sheets provided in the feeding direction, is potentially possible, however, the implementation of such potentiality is possible only if the reduction of the required braking time can be achieved at the same time.

As already described above with the use of the printing sheet brake according to the present invention, in this case, the next printing sheet is already above the trailing edge of the preceding printing sheet (overlaying), which already by initiating the folding impulse is moved in the direction of the folding-roller pair.

The printing sheet located on top, which is still clamped in the feeding belts, in this instance recognizes a guide function with respect to the printing sheet to be folded, in that it prevents the printing sheet located on the bottom from being able to rise to the top as a result of the accelerations, whereby the known quality-reducing effects (whipping effect, donkey ears) can be prevented.

Therefore, it is substantial for the present invention to design of the device and its operation for decelerating a transported and flat-formed product. A substantial implementation of the invention here relates to a device and a method for decelerating printing products, preferably printing sheets, in this case, the brake consequently being a printing sheet brake.

Therefore, this device is designed as an air-jet-operated brake, which is operated with an air jet supplied by an air jet nozzle, this brake having at least one body, which by the action of the air jet, i.e., by its impulse force, implements a braking effect on the printing product, so that this body per se forms the active immediate brake. The body itself is made up of at least one first element, which is preferably designed in a shell-shaped manner, this shell shape by its physical configuration ensuring, a continuing jet deflecting flow of the supplied air jet.

Furthermore, it is such that this body acting as a brake is supplemented by at least one second element, which is responsible for the subsequent implementation of the impulse force, in that this second element preferably is designed as a flexible tab, which is clamped on one side, preferably diametrically opposite to the location of the first element, and this second element undergoes a bending towards the printing product, which is implemented by the respective spring constant by way of the impulse-set triggered by the air jet onto the first element, whereupon the entire braking effect of the first element can be implemented onto the printing product.

According to the present invention, it is substantial to further implement the braking force effect on the printing product, preferably also by two bodies, which are preferably spaced apart transversely to the transport direction, also called feeding direction, of the printing sheet, and these braking force-triggering bodies each are operated simultaneously in cycle by at least one air jet nozzle.

According to the present invention, also at least two bodies, which can be operated operatively side by side, can be provided at each braking location, which exert their braking force alternatingly at least per sheet. If, for example, two arranged braking locations are provided for each printing sheet, the number of individually active bodies then increases to four. Here also, preferably at least one air jet nozzle per body is provided. The essential advantage of such a disposition and the alternating operation of the bodies among themselves is to be seen in that the number of cycles can be substantially increased in that an operation-inherent redundancy is created, and that the wear of the valves can be substantially minimized.

Preferably, the air jet nozzle is characterized by a single centrally located opening, through which the air jet exits with supersonic speed. If an increase in the flow velocity of the air jet here is to be targeted, this can be easily achieved by forming the opening as a Laval nozzle.

However, in addition to the central opening, the air jet nozzle may have at least another opening, which serves as a complementary air mass flow-emitting opening, preferably fulfilling the function of a damping aid.

As far as the shell-shaped body impinged by an air mass flow is concerned, the underlying shell here is rotationally symmetrically configured, the interior of which has a concave shape with respect to the air jet emitted by the air jet nozzle, so that the air jet can exert an optimal impulse force on the shell and then flow out unhinderedly.

In order to maximize the effectiveness of the flow within the shell, the shell has a centrally arranged conical or nearly conical column, via which the air jet emitted by the air jet nozzle flows in a flow-homogeneous manner into the concavely shaped interior, and, after implementing the impulse force, an air jet deflection and a return flow results within this concave interior after the of the impulse force to.

This underlying flow homogeneity can then be increased, if the shell is supplemented by a centrally situated conical or nearly conical column, which sometimes can also project over the top edge of this shell. Then, in order to further increase the flow homogeneity, the centrally situated conical or nearly conical column is to be formed from top to bottom, preferably by a taper, which is so modeled that it merges seamlessly into the concavely shaped interior of the shell.

Then, this air jet deflection experiences, by the described concave shape of the shell, an efficiency-maximized return-flow, which takes place optimally by 90° up to ≥180° relative to the air mass flow from the air jet nozzle.

According to the present invention, however, the first element is not to be able to be designed only as a shell, but this element can also have an open structure, which has a central protruding edge on the upper side, from which an air-jet deflecting, wing-like structure extending on both sides of this edge stretches up to the second element, this edge, based on a predetermined transport direction of a product, can take any orientation.

At least the second element of the brake designed as a tab, having an on-demand spring constant, is operatively connected to at least one pneumatic damping provision and/or to mechanically operable damping elements, which are all so designed that they can efficiently dampen a swinging movement of this second element after a completed braking movement.

The present invention also relates to a method for operating the described device for decelerating a transported and flat configured product, preferably a printing product, in particular a printing sheet, the device being designed as a brake operable by an air jet, wherein the brake is operated with an air jet supplied by at least one air jet nozzle, wherein the brake is formed by at least one body exerting a braking force on the product by the action of the air jet, the brake being operated in an operative connection with a downstream folding device, and the brake being operated so that the braking force simultaneously acts upon the trailing for fixing the product, in such a manner that a space is created, whereby a collision with the subsequent product is avoided.

Substantial advantages of the invention can be seen in that: a maximization of the resulting braking force due to an air jet deflection is achieved at a constant energy consumption; a deflection of the air jet away from printing sheets can be ensured, whereby no air-related interference takes place on the printing sheets; a cost-effective and wear-free brake booster can be provided; the printing sheet brake creates the prerequisite that the folding process can proceed an undisturbed and efficient manner.

In the following, the invention will be explained with reference to the drawings, to which, with respect to all details substantial to the present invention and not described in greater detail, is explicitly made reference. All elements not substantial for the immediate understanding of the present invention have been omitted; the same elements are provided with the same reference numerals in the various figures.

FIG. 1 shows an overall view of printing sheet brake 100, which is per se directed to illustrate a single braking-power generating unit. It is readily possible, if necessary, to provide several units, which can be positioned in different manners in relation to each other, which then exert the braking force on printing sheet A located on folding table 200 in a predetermined cycle.

Thus, it can be arranged that the braking force acting on the printing sheet is preferably carried out by two bodies 120, which are preferably spaced apart within the width of the printing sheet and transversely to feeding direction 300 thereof. Preferably, at least one air jet nozzle 110 should be provided per body. In such a configuration, it is important that the braking force must uniformly and simultaneous act via the two braking-force-acting bodies, so that no distortion can result on for the position of the printing sheet. Such a configuration is not apparent here in the drawing, but is easy to understand for a person skilled in the art.

It is also possible to provide at least two operational braking-force-acting bodies 120 operable side by side at each braking location, which exerts their braking force alternately at least for each printing sheet A. If, for example, two arranged braking locations are provided per printing sheet, the number of individually active bodies 120 increases to four.

Also, here at least one air jet nozzle 110 is preferably provided for each body 120. The substantial advantage of such a disposition is certainly that the operation of the two or more coordinated bodies 120 may take place alternately, so that the number of cycles thereby can be significantly increased and that consequently an operation-inherent redundancy is created, whereby the wear rate of the valves responsible for operating the braking-force-acting bodies 120 can be substantially minimized.

Illustrated printing sheet brake 100 is supported by a support 101, which must have maximum stability, so that further elements of printing sheet brake 100 anchored there have a minimized susceptibility to vibration owing to the high cycle numbers of the machine. Support 101 has an intermediary anchoring 102 for the attachment of an air jet nozzle 110, the air jet of which is directed against the further components of printing sheet brake 100, these components being disposed above the transport plane of the printing sheets A, as is also clear from FIGS. 2 and 4.

These components belonging to printing sheet brake 100 are basically divided into two main elements. Firstly, a first designed element 120 is concerned, which functions essentially as an independent unit; this element substantially is made up of, on the one hand, a flexible component designed as a flat shaped tab 121 the material or material composition or material combination, of which has, as function of the braking force to be exerted, a tuned spring rate and furthermore first element 120 is made up of a shell-shaped component 122, which is operatively connected to tab 121, shell 122 being directly impinged by air jet 400 from air jet nozzle 110.

Air jet 400 introduced by air jet nozzle 110 (see also FIG. 3) by its impulse force generates the braking force action of printing sheet brake 100 per se, wherein shell 122, by the effect of air jet 400 being such that flexibly formed flat tab 121 bends downwardly, and in this way exerts a pressing force on printing sheet A situated below by the feeding (see also FIG. 2).

Accordingly, first flexibly designed element 120 is made of the shown component in the form of a flexible tab 121 and a shell 122 placed thereon, the concavely designed inner shape of the shell 122 ensuring a continuous jet deflecting flow of supplied air jet 400.

This air jet deflecting shell 122 is arranged above transported printing sheet A and is, as already explained, directly in operative connection with flexibly clamped tab 121, which is preferably anchored on one side 123 so that its flexibility can be fully realized, this flexibility dependent on the spring constant characterizes the transmission of the pressing force onto the sheet. Therefore, the underside of this flexible tab 121 exerts a force impulse, applied by the air jet via air jet deflecting shell 122, in the form of a pressing force onto printing sheet A, which pressing force then comes into effect as a direct braking force, so that detected printing sheet A is instantaneously decelerated to zero within a few milliseconds.

This tab 121 can be covered on the underside, thus the printing sheet side, with a coating, which effectively supports the deceleration of the printing sheet.

As can be seen from FIG. 1, shell 122 is situated at the end of tab 121 and diametrically to one-sided clamping 123 of this tab 121, whereby the possible flexibility of this tab can be maximized.

Furthermore, first flexibly designed element 120 is operatively connected to a second element 130, which is designed as a mechanical damping element 131.

This second element 130 has the shape of a rigid beam 133, and it is then also anchored on one side 132; in the shown example, this beam 133 for reasons of space is also connected at the location of anchoring to flexible tab 121. Damping element 131 disposed at the end of beam 133 generally fulfills a damping function, which counteracts a possible swinging movement of flexibly designed tab 121 after completed braking. In this context, damping element 131 is to be made of a particularly vibration-damping material, so that the swinging movement of flexible tab 121 can be abruptly damped. This damping element 131 is advantageously situated in the immediate vicinity of shell 122, in order to maximize its damping effect.

Figure 2:
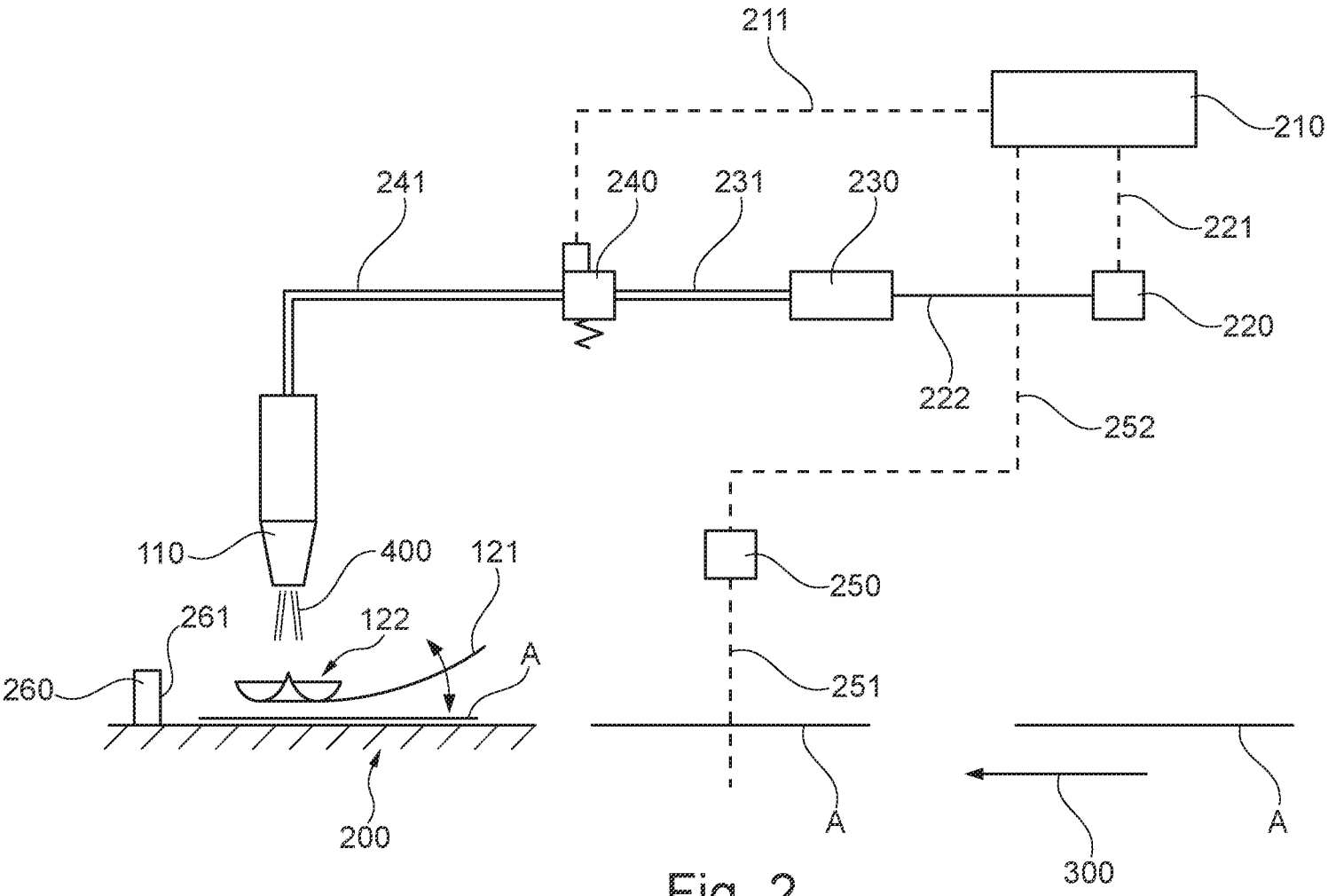
FIG. 2 shows a schematic diagram, which reflects the operation of the brake.

FIG. 2 shows an overall diagram for the operation of the brake according to FIG. 1. In this figure, first, the complementary element in connection with concavely designed shell 122 (see also FIG. 3) and flexible tab 121 can be seen. Below concavely designed shell 122 actual folding table 200 is located, having a printing sheet A symbolically illustrated thereon, the braking force introduced onto the printing sheet is operationally in operative connection with printing sheet A delivered in feeding direction 300.

Furthermore, the position-accurately positioning of decelerated printing sheet A is crucial for quality assurance, in particular with respect to the subsequent operations. This quality assurance can be maximized by supplementing the system with a printing sheet stop 260, which comes into action at the very last phase of the deceleration and ensures that any possible misalignment caused by transportation or mostly by the implementation of the braking force definitely can be compensated by 100%.

For this purpose, the released kinematic energy has already flowed almost completely in the deceleration during the local impingement of printing sheets A on the printing sheet stop 260. Only remaining is a feeding speed 300 striving towards zero, which ensures that printing sheet A can smoothly align at stop surface 261. Printing sheet stop 260 may be made of a body which largely covers the entire feeding width of the printing sheet or which is made of a number of body parts spaced apart. It is obvious that there is an interdependence between the remanence speed and the braking effect which is not-fully exhausted.

Although the final positioning of printing sheet A is thus determined with the aid of a printing sheet stop 260, it nevertheless must be ensured in all cases that printing sheet A by its remanence speed impacts (entire) stop surface 261 of printing sheet stop 260 only very smoothly. As this remanence speed is microscopically small, as stated, there is also no danger that the leading edge of printing sheet A in feeding direction 300 is damaged when impacting stop surface 261, or that it could spring back and/or recoil from stop surface 261.

This gently performed implementation in terms of the final position of printing sheet A has the additional advantage that the printing sheet can completely conform to the course of stop surface(s) 261, which results in a definitively maximized accurate alignment of printing sheet A, and in addition in a quality assurance for subsequent operations.

This FIG. 2 also shows the elements, upon which the pneumatic control/regulation of the brake is based. Firstly, a high-level control unit 210 is operated here, into which information flows which issues commands. Important information relates to detection 251 of fed printing sheet A via a light barrier 250. This information 252 is forwarded to control unit 210, which by stored- or by continuously adjusted control profiles ensures that the braking effect comes into function when the concerned printing sheet has reached the operative position in front of the printing sheet stop 260. This includes that via a control line 221 a command is issued to pressure regulator 220, which is in an operative connection 222 with a downstream pressure accumulator 230, which in turn is in an operative connection 231 with a switching valve 240.

At a given time, this valve 240, from control unit 210 receives a command to take action, via another control line 211, and to provide that amount of air to air jet nozzle 110 for the implementation of the braking effect. The air quantity through a compressed air line 241 and then as a jet 400 flows at high pressure and velocity out of air jet nozzle 110, and acts on concavely designed shell 122, via which the braking force is then transmitted to printing sheet A in an operative connection with the tab 121, taking into account the dynamics described above in connection with printing sheet stop 260.

As far as the switch of pneumatic switching valve 240 is concerned, the valve is triggered by the mentioned signal, taking into account dead time and speed compensation. Then, the air stored in pressure accumulator 230 is suddenly released, after which air jet nozzle 110 then emits an impulse-like air jet. After the emission of the impulse-like air jet, pneumatic switching valve 240 is immediately closed, and pressure regulator 220 fills pressure accumulator 230 again with the preset pressure and is then available for the next cycle.

However, an operation with a pressure accumulator is not indispensable: The cycle-conditioned impulse emission of a certain amount of air under a certain pressure can also be achieved by a dynamically designed control which directly ensures a continuous compressed air supply.

Figure 3:
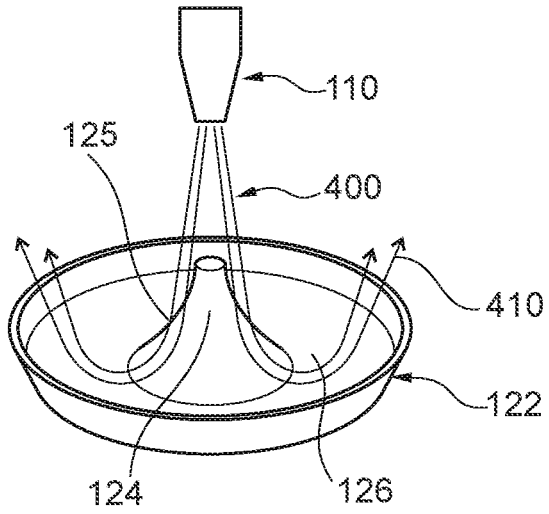
FIG. 3 shows a three-dimensional representation of the impulse-transmitting shell-shaped body.

FIG. 3 shows the three-dimensional image of concavely designed shell 122, which is devised for implementing the amount of air jet 400 flowing out of the air jet nozzle 110 with a high impulse force.

As far as shell-shaped shell 122 impinged by the amount of air jet 400, is concerned, the underlying body here is rotationally symmetrically designed, the interior of which is concavely designed with respect to air jet 400 emitted by air jet nozzle 110, so that air jet 400 can exert an optimal impulse force on shell 122 and then flow out again unhinderedly 410.

In order to best manage the braking-force-triggering flow within shell 122, the shell has a centrally situated conical or nearly conical column 124, via which air jet 400 emitted by the air jet nozzle 110 flows in a flow-homogeneous manner into the concavely designed inner space, and within this concave inner space an air jet deflection 410 results after implementing the impulse force.

This underlying flow homogeneity can then be increased, if shell 122 is supplemented by a centrally situated conical or nearly conical column 124, which projects beyond the uppermost edge of this shell 122. In order to further increase the flow homogeneity, the centrally situated conical or nearly conical column 124 is to be configured from top to bottom, preferably by a taper 125, which is modeled so that it merges seamlessly into next concavely designed inner space 126 of shell 122.

This air jet deflection by the described concave shape of the shell, then experiences an efficiency-maximized return-flow 410, which is optimally carried out by 90° to ≥180°, relative to air jet 400 from air jet nozzle 110.

Figure 4:
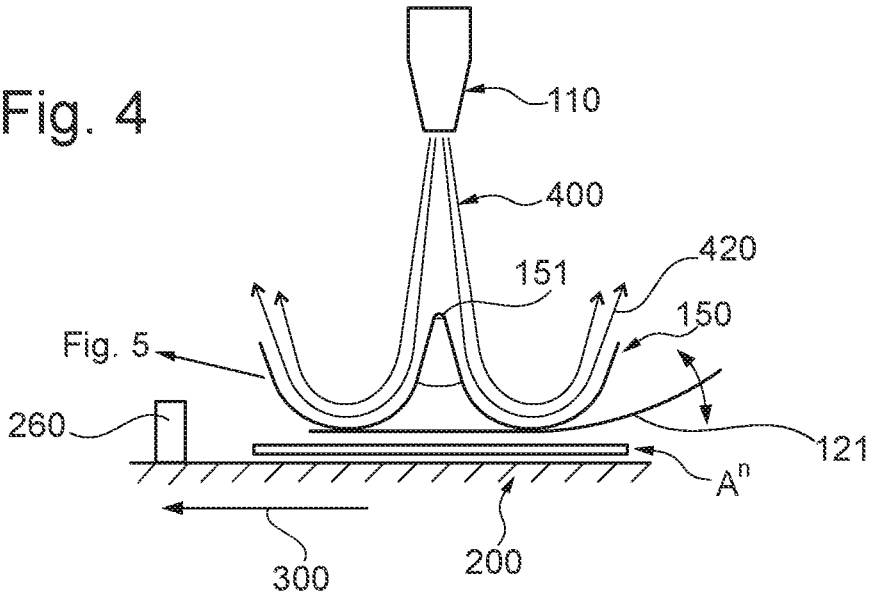
FIG. 4 shows an illustration of another impulse-transmitting body.

FIG. 4 shows another air-jet deflecting body 150, which essentially fulfills the same function as shell 122, which has already been described several times. This body 150, which further is three dimensionally presented in FIG. 5, has a central protruding edge 151 on the upper side. The two-sided flanks extend downwards according to an air-jet-deflecting wing-like structure (see FIG. 5, item 152) and extend up to the area of a flexible tap 121 operatively acting thereunder, and this edge, based on a predetermined feeding direction 300 of a product A, in general, can assume any orientation.

In this FIG. 4, it is then shown that the brake is not limited only to the deceleration of individual printing sheets but that it is readily possible to provide, on the folding table 200, multi-layer sheets A″ for the immediate deceleration as well as for further processing. It should also be noted that return-flow 420 for this body 150 will tend to be shallower with respect to the shell (122). This figure further shows printing sheet stop 260 already described in FIG. 2 and corresponding feeding direction 300 of printing products A″.

Figure 5:
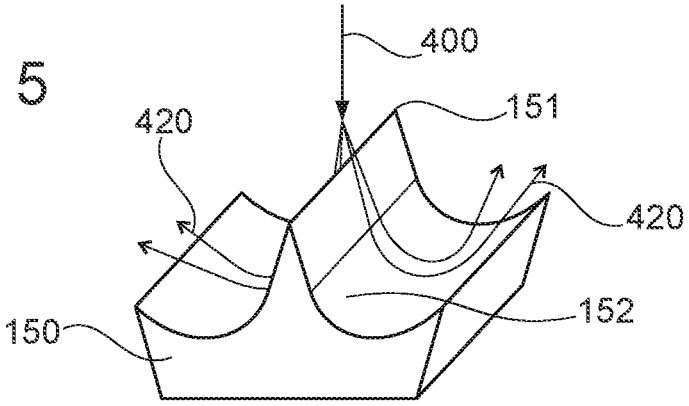
FIG. 5 shows a three-dimensional representation of the impulse-transmitting body according to FIG. 4.

FIG. 5 accordingly shows body 150 in a three-dimensional view. Here, it can be well seen, the upper side of the body has a rather pointed edge 151, which sharply divides air jet 400 of the air jet nozzle, whereupon these partial air-streams 420 flow out on both sides of the body 150. Since body 150 has an air-jet deflecting wing-like structure 152 extending downwardly, which then at the end merges into a concave-like shape, here also a return-flow is generated due to the exerted impulse force.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A device for decelerating a transported and flat shaped product, the device comprising:

a brake comprising:

an air jet nozzle; and a braking force implementing body operable by an air jet supplied by the air jet nozzle, the air jet nozzle being configured to impinge the air jet on the braking force implementing body to exert a braking force on the flat shaped product, wherein the braking force implementing body comprises:

at least one first element, which comprises a physical structure for a return-flow of the air jet supplied by the air jet nozzle, and at least one second element, which for the braking force implementation is in an operative connection with the first element, the second element configured to implement an impulse force caused by the air jet from the air jet nozzle, the impulse force resulting as the braking force onto the flat shaped product.

2. The device according to claim 1, wherein the flat shaped product is a printing product.

3. The device according to claim 1, wherein the brake is a printing sheet brake.

4. The device according to claim 2, wherein the printing product is a printing sheet, and wherein the device comprises two braking force implementing bodies which comprise the braking force implementing body, the two braking force implementing bodies configured to carry out the braking force acting on the printing sheet, the two braking force implementing bodies being spaced apart from each other and arranged transversely to a feeding direction of the printing sheet.

5. The device according to claim 4, wherein at least one air jet nozzle, comprising the air jet nozzle, is configured to impinge at least one air jet, comprising the air jet, upon each of the two braking force implementing bodies.

6. The device according to claim 1, wherein the device comprises a plurality of braking locations, wherein at each braking location at least two operatively operable braking force implementing bodies are situated, and which are configured to exert the braking force alternatingly at least within a cycle, and wherein the at least two operative operable braking force implementing bodies at one of the braking locations comprises the braking force implementing body.

7. The device according to claim 6, the device comprising at least one air jet nozzle, comprising the air jet nozzle, the at least one air jet nozzle is configured to impinge at least one air jet, comprising the air jet, upon each of the operatively operable braking force implementing bodies.

8. The device according to claim 2, wherein the printing product is a printing sheet, wherein the brake and its braking force are in operative connection with a printing sheet stop, and wherein the printing sheet stop comprises a stop surface, which serves as a reference edge of a decelerated printing sheet in a feeding direction.

9. The device according to claim 1, wherein the air jet nozzle comprises at least one central opening.

10. The device according to claim 1, wherein the air jet nozzle is operable supersonically.

11. The device according to claim 1, wherein the air jet nozzle is a Laval nozzle.

12. The device according to claim 9, wherein the air jet nozzle comprises at least one second opening which is complementary to the at least one central opening.

13. The device according to claim 1, wherein the first element of the braking force implementing body comprises a rotationally symmetrical shell, an interior of which is concave with respect to the air jet emitted by the air jet nozzle in such a way that the air jet exerts an impulse force on the rotationally symmetrical shell.

14. The device according to claim 13, wherein the rotationally symmetrical shell has a centrally situated conical or nearly conical column, which is configured such that the air jet emitted by the air jet nozzle flows into the concavely shaped interior in a flow-homogeneous manner, and such that within the concavely shaped interior a return flow results after the implementation of the impulse force by air jet deflection.

15. The device according to claim 14, wherein the device is configured such that the return-flow of the air jet emitted by the air jet nozzle occurs at 90° to ≥180° relative to the air jet from the air jet nozzle.

16. The device according to claim 14, wherein the centrally situated conical or nearly conical column protrudes beyond an uppermost edge of the rotationally symmetrical shell.

17. The device according to claim 14, wherein the centrally situated conical or nearly conical column from top to bottom comprises a taper which extends in such a way that it seamlessly merges into the concave shaped interior of the rotationally symmetrical shell.

18. The device according to claim 1, wherein the first element comprises a flow body, having an upper side that comprises a central protruding edge, from which an air-jet deflecting structure extending up to the second element, extends on both sides of the central protruding edge.

19. The device according to claim 18, wherein the air-jet deflecting structure is a wing-shaped air-jet deflecting structure.

20. The device according to claim 18, wherein the centrally protruding edge of the flow body comprises an arbitrary orientation with respect to a predetermined feeding direction of the flat shaped product.

21. The device according to claim 1, wherein the second element supports the first element on one side, and is flexibly clamped on an other side above the flat shaped product, that by the outgoing impulse by the air jet onto the first element, a bending of the second element takes place, in such a way that by the bending, an underside of the second element exerts a pressing force on the flat shaped product.

22. The device according to claim 21, wherein the second element is configured as a flexible, flat shaped tab.

23. The device according to claim 22, wherein the tab comprises gaps.

24. The device according to claim 22, wherein the tab is made of a material comprising a spring constant aligned with respect to the applied braking force.

25. The device according to claim 24, wherein the spring constant is changeable by a multilayer sheet structure of the tab.

26. The device according to claim 1, wherein at least the second element is in operative connection with at least one superimposed damping device, which is directed against a swinging movement of the second element after a completed braking movement.

27. The device according to claim 26, wherein the damping device comprises an end-side anchored beam and damping elements.

28. The device according to claim 27, wherein the damping elements are disposed adjacent to the first element.

29. The device according to claim 1, wherein the first element and/or the second element are configured for damping purposes to be impinged by pneumatic forces against a swinging movement after a braking has occurred.

30. The device according to claim 29, wherein the air jet for damping purposes is supplied directly from a main opening of the air jet nozzle.

31. The device according to claim 29, wherein the air jet for damping purposes is supplied from another opening of the air jet nozzle separate from a main opening for applying the braking force.

32. The device according to claim 29, wherein the air jet for damping purposes is supplied from an arrangement of holes, which are arranged in a ring shape around a main opening of the air jet nozzle, the holes being smaller than the main opening.

33. A method for operating a device for decelerating a transported and flat shaped product, the device comprising a brake, the brake comprising at least one air jet nozzle, and at least one body operable by an air jet supplied by the at least one air jet nozzle, the at least one body exerts a braking force on the flat shaped product by the effect of the air jet, the method comprising:

operating the brake by impinging the air jet supplied by the air jet nozzle on the at least one body in such a way that, for fixing the flat shaped product, the braking force simultaneously acts upon a trailing edge of the flat shaped product in such a way that a space is created in order to avoid a collision with a subsequent flat shaped product, wherein the subsequent flat shaped product is guided higher than a surface of a folding table.

34. The method according to claim 33, wherein by action of the air jet, exerting an implementing force for a braking action on the flat shaped product, and wherein the brake is operated in an operative connection with a downstream folding device.

* * * * *